US006918811B1

(12) United States Patent
Wang

(10) Patent No.: US 6,918,811 B1
(45) Date of Patent: Jul. 19, 2005

(54) ROBOTIC TOY

(76) Inventor: Sheng-Chien Wang, No. 120, Shen-Kang-CHung St., Shenkang Hsiang, Taichung Hsien (TW)

( * ) Notice: Subject to any disclaimer, the term of this patent is extended or adjusted under 35 U.S.C. 154(b) by 0 days.

(21) Appl. No.: 10/957,546

(22) Filed: Oct. 1, 2004

(51) Int. Cl.[7] ..... A63H 3/36

(52) U.S. Cl. ..... 446/373; 446/377; 446/379; 180/8.1

(58) Field of Search ..... 446/330, 352, 446/355, 353, 356, 475, 376–381; 901/2, 6, 8, 9, 15; 318/568.11, 568.12, 568.21, 568.24; 180/8.1, 806

(56) References Cited

U.S. PATENT DOCUMENTS 4,613,315 A * 9/1986 Kataoka ..... 446/355
4,629,440 A * 12/1986 McKittrick et al. ..... 446/356
5,337,235 A * 8/1994 Takahashi et al. ..... 701/23
5,842,533 A * 12/1998 Takeuchi ..... 180/8.1
6,120,249 A * 9/2000 Hultgren et al. ..... 416/97 R
6,454,624 B1 * 9/2002 Duff et al. ..... 446/91
6,605,914 B2 * 8/2003 Yim et al. ..... 318/568.11
6,705,917 B2 * 3/2004 Filo ..... 446/379

* cited by examiner

*Primary Examiner*—Kien Nguyen
(74) *Attorney, Agent, or Firm*—Alan D. Kamrath; Nikolai & Mersereau, P.A.

(57) ABSTRACT

A robotic toy has a pedestal, a stand assembly, a transmission device, a shoulder, an arm assembly and a body casing assembly. The stand assembly is mounted on the pedestal and has an upper bracket. The transmission device is mounted pivotally on the upper bracket of the stand assembly and has a hollow body, a motor and a gear assembly. The shoulder is mounted movably on the hollow body and oscillates in response to the motor. The arm assembly is attached to the shoulder and has a forearm pivoting up and down in response to the transmission device. The operating motor causes the transmission device to rock, the shoulder to oscillate and the forearm to pivot up and down. Thereby the robotic toy with a decorative musical instrument looks like a lively person or creature playing a musical instrument.

6 Claims, 9 Drawing Sheets

ROBOTIC TOY

BACKGROUND OF THE INVENTION

1. Field of the Invention

The present invention relates to a toy, and more particularly to a robotic toy with a swaying body, hands playing a musical instrument and boots beating time.

2. Description of Related Art

Various robotic toys have been disclosed and appeared in the market. Conventional robotic toys are driven by electricity and move to attract and please people especially children. However, the motion of the toys is usually rigid and unrealistic and hardly attracts consumers. Such toys commonly have a movable head or body that rocks monotonously and bores children easily after a relatively short period of use.

To overcome the shortcomings, the present invention provides a robotic toy to mitigate or obviate the aforementioned problems.

SUMMARY OF TH INVENTION

The main objective of the invention is to provide a robotic toy that has a swaying body, hands playing a musical instrument and boots beating time to attract and please people especially children.

A robotic toy to accomplish the objective has a pedestal, a stand assembly, a transmission device, a shoulder, an arm assembly and a body casing assembly. The stand assembly is mounted on the pedestal and has an upper bracket. The transmission device is mounted pivotally on the upper bracket of the stand assembly and has a hollow body, a motor and a gear assembly. The shoulder is mounted movably on the hollow body and oscillates in response to the motor. The arm assembly is attached to the shoulder and has a forearm pivoting up and down in response to the transmission device.

Other objectives, advantages and novel features of the invention will become more apparent from the following detailed description when taken in conjunction with the accompanying drawings.

DETAILED DESCRIPTION OF PREFERRED EMBODIMENT

Figure 1:
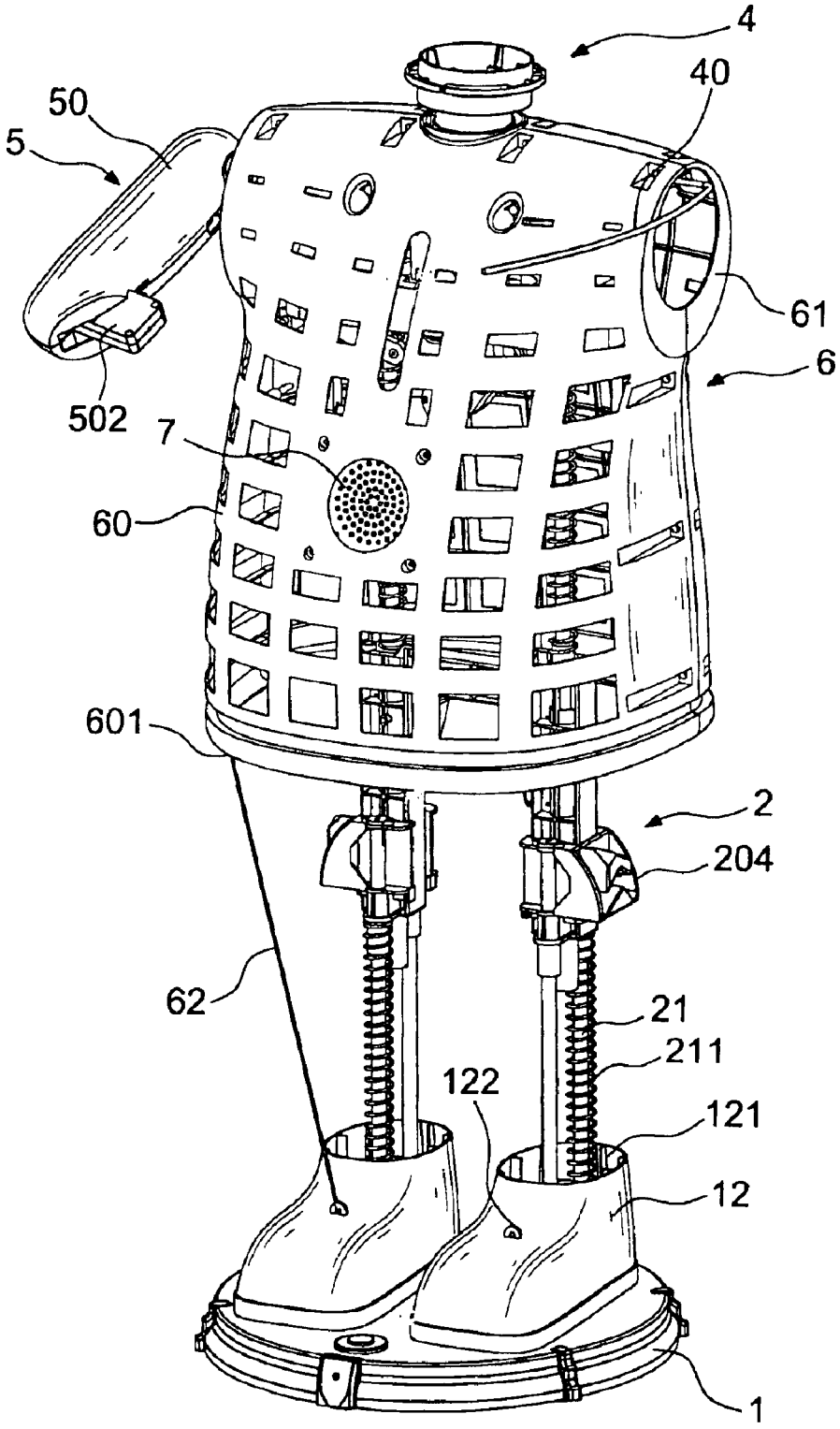
FIG. 1 is a perspective view of a robotic toy in accordance with the present invention.

With reference to FIGS. 1, 2, 3 and 10, a robotic toy in accordance with the present invention comprises a pedestal (1), a stand assembly (2), a transmission device (3), a shoulder (4), an arm assembly (5), a body casing assembly (6), an optional control device and an optional speaker (7).

The pedestal (1) has a top surface, two sets of multiple mounting sleeves (10), two boot-pivoting members (11) and two boots (12). The sets of mounting sleeves (10) are formed on the top surface of the pedestal (1) beside each other. The mounting sleeves (10) in each set are arranged at intervals. Each mounting sleeve (10) has an open top. The boot-pivoting members (11) are formed on the top surface of the pedestal (1) and respectively behind the sets of mounting sleeves (10).

The boots (12) are pivotally attached respectively to the boot-pivoting members (11) and around the sets of mounting sleeves (10). Each boot (12) has a front top surface, a bottom edge, a through hole (121) and an eye (122). The bottom edge has a back part pivotally attached to the boot-pivoting member (11) to allow the boot (12) to pivot on the boot-pivoting member (11). The through hole (121) is defined vertically through the boot (12) and corresponds to a set of mounting sleeves (10). The eye (122) is formed on the front top surface of the boot (12).

The stand assembly (2) is mounted on the pedestal (10) and has two sets of multiple lower stands (21), a medial bracket (20), two sets of multiple upper stands (21*a*) and an upper bracket (22).

The sets of lower stands (21) correspond to and are mounted respectively in the sets of mounting sleeves (10) on the pedestal (1). Each lower stand (21) has a bottom end, a top end and a lower spring (211). The bottom end of each lower stand (21) is mounted securely inside the open top of a corresponding mounting sleeve (10). The lower spring (211) is mounted around the lower stand (21) and has a top end and a bottom end abutting the open top of the corresponding mounting sleeve (10).

The medial bracket (20) is mounted slidably on the lower stands (21), abuts the top ends of the lower springs (211) and has a top, a bottom, two legs (201), two sets of multiple lower sleeves (203), two upper sleeves (203*a*) and two fasteners (204). The legs (201) are formed on the bottom of the medial bracket (20) and correspond respectively to the sets of lower stands (21). Each leg (201) has a bottom end and an outer side.

The sets of lower sleeves (203) are formed respectively on the bottom ends of the legs (201), correspond to the sets of lower stands (21) and the lower springs (211), are mounted respectively around the lower stands (21) and respectively abut the top ends of the lower springs (211).

The upper sleeves (203*a*) are formed on the top of the medial bracket (20), and each sleeve (203*a*) has an open top end and a closed bottom end. Each upper sleeve (203*a*) has a through hole defined through the upper sleeve (203*a*), which allows the corresponding lower stand (21) to pass through the upper sleeve (203*a*).

The fasteners (204) are mounted respectively on the outer sides of the legs (201) of the medial bracket (20).

The upper stands (21*a*) correspond to the upper sleeves (203*a*) and are mounted respectively in the open top ends of the upper sleeves (203*a*). Each upper stand (21*a*) has a top end and an upper spring (211*a*). The upper springs (211*a*) are mounted respectively around the upper stands (21*a*), and each upper spring (211*a*) has a top end and a bottom end abutting the open top end of the corresponding sleeve (203*a*).

Figure 2:
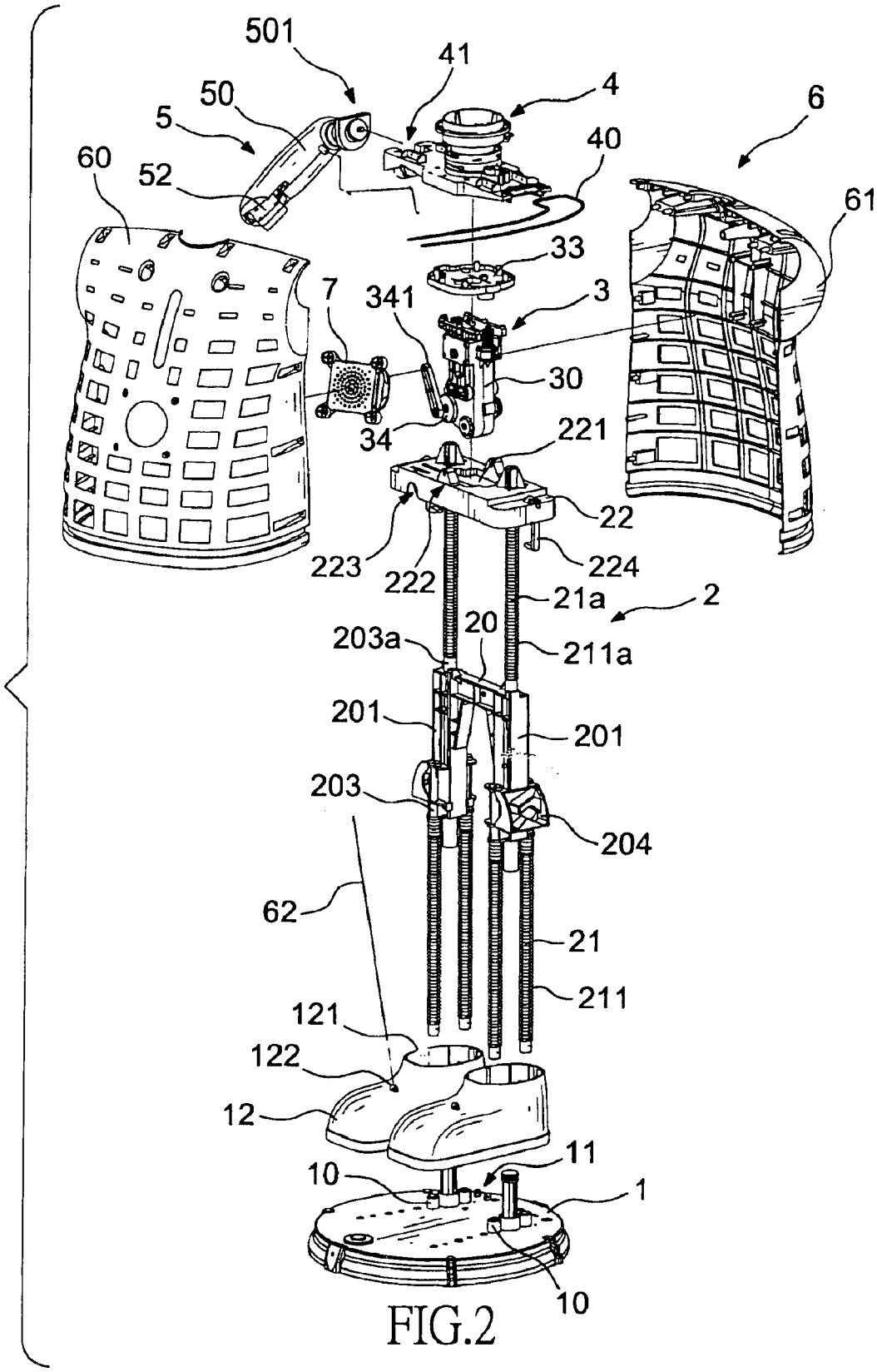
FIG. 2 is a partially exploded perspective view of the robotic toy in FIG. 1.
Figure 3:
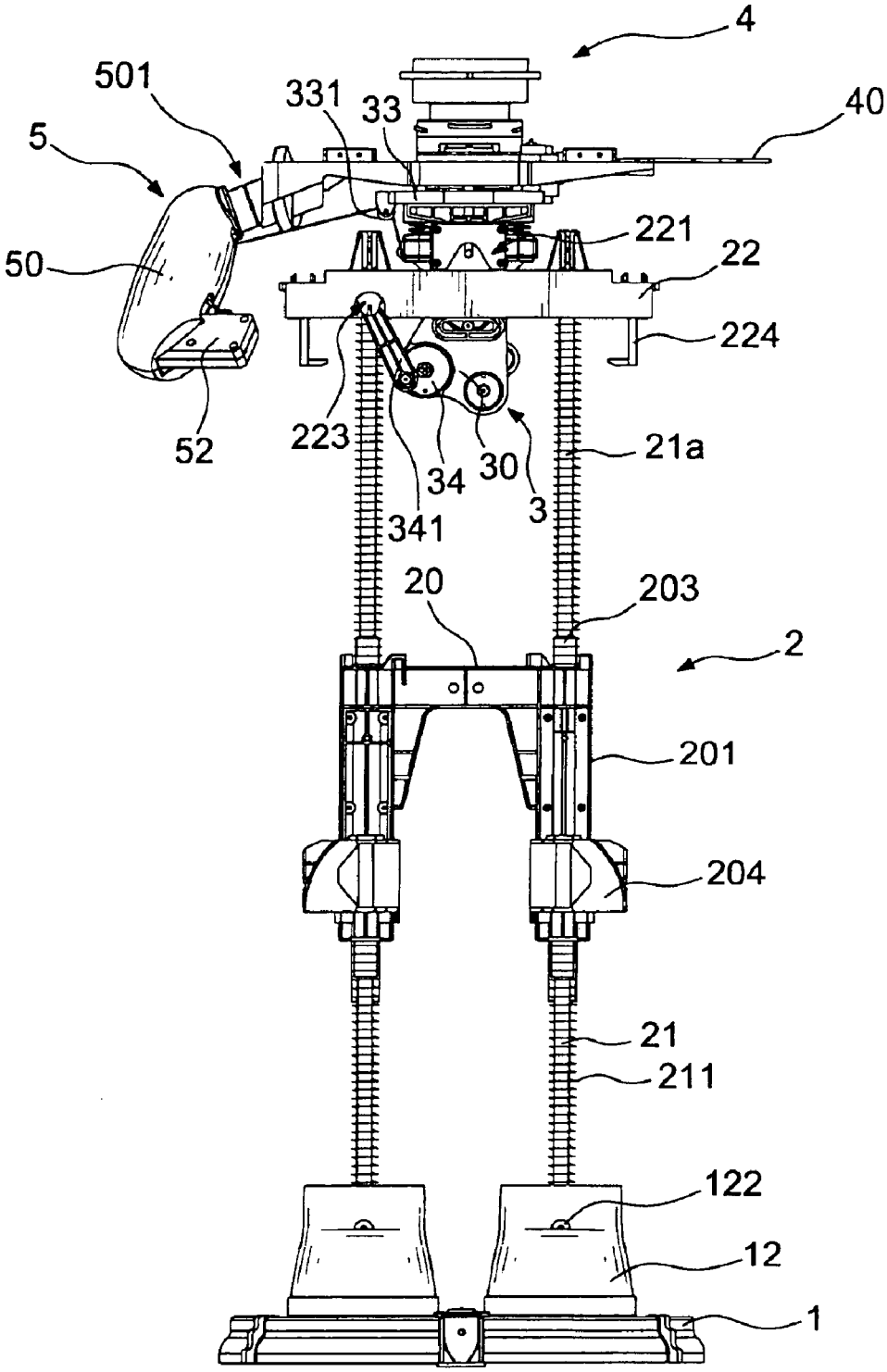
FIG. 3 is a front view of the robotic toy in FIG. 1 without the body casing assembly.

With reference FIGS. 2 and 3, the upper bracket (22) is mounted securely on the top ends of the upper stands (203*a*) and has a top surface, a bottom surface, a front, two sides, a transmission-pivoting hole (221), two transmission-pivoting mounts (222), a rocker arm mount (223) and two hooks (224). The bottom surface of the upper bracket (22) abuts the top ends of the upper springs (10). The transmission-pivoting hole (221) is defined through the upper bracket (22). The transmission-pivoting mounts (222) are formed on the top surface of the upper bracket (22) and respectively in front of and behind the transmission-pivoting hole (221). The rocker arm mount (223) is formed on the bottom surface close to one side of the upper bracket (22). The hooks (224) are formed respectively on the sides of the upper bracket (22).

Figure 4:
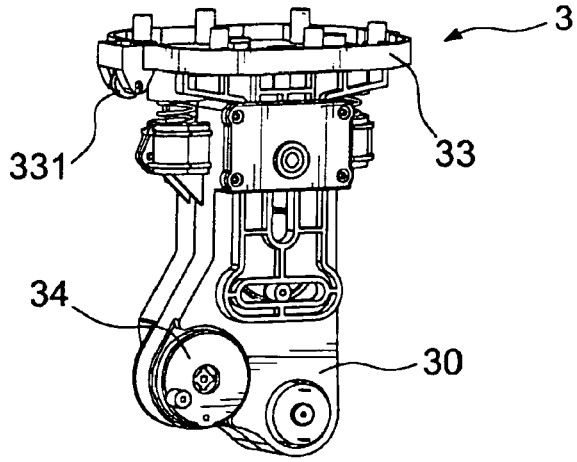
FIG. 4 is a perspective view of the transmission device of the robotic toy in FIG. 1.
Figure 5:
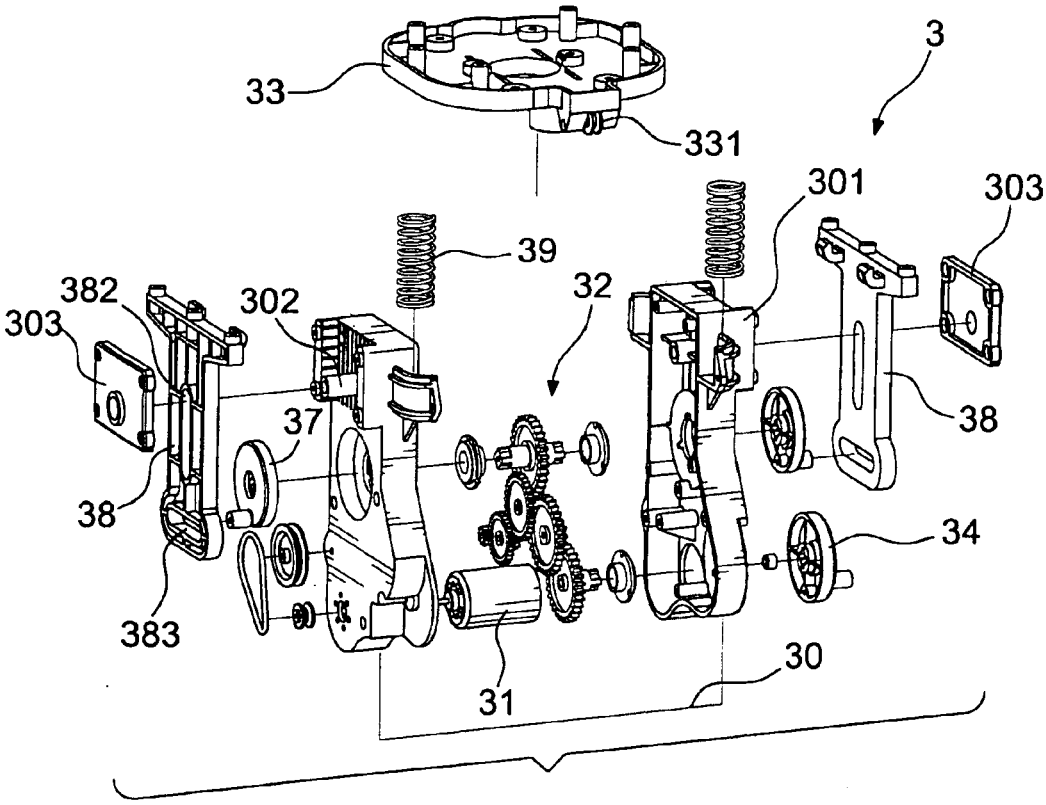
FIG. 5 is an exploded perspective view of the transmission device of the robotic toy in FIG. 1.

With further reference to FIGS. 4 and 5, the transmission device (3) is mounted pivotally through the transmission-pivoting hole (221) in the upper bracket (20) and has a hollow body (30), a motor (31), gear assembly (32), a rocker wheel (34), two lifting wheels (37), two lifting arms (38), a shoulder bracket (33) and two optional springs (39).

The hollow body (30) is mounted pivotally between the transmission-pivoting mounts (222) through the transmission-pivoting hole (221) and has a top, a bottom, a front, a back, two sides, two pairs of guide rails (301), two guide posts (302) and two covers (303). The pairs of guide rails (301) are formed respectively on the front and back, adjacent to the sides and close to the top of the hollow body (30). The guide posts (302) are formed respectively between the pairs of guide rails (301) on the front and back. The covers (303) correspond to and are mounted respectively on the pairs of guide rails (301).

The motor (31) is mounted inside the hollow body (30).

The gear assembly (32) is mounted inside the hollow body (30) and has multiple gears engaged with each other and rotated by the motor (31).

Figure 6:
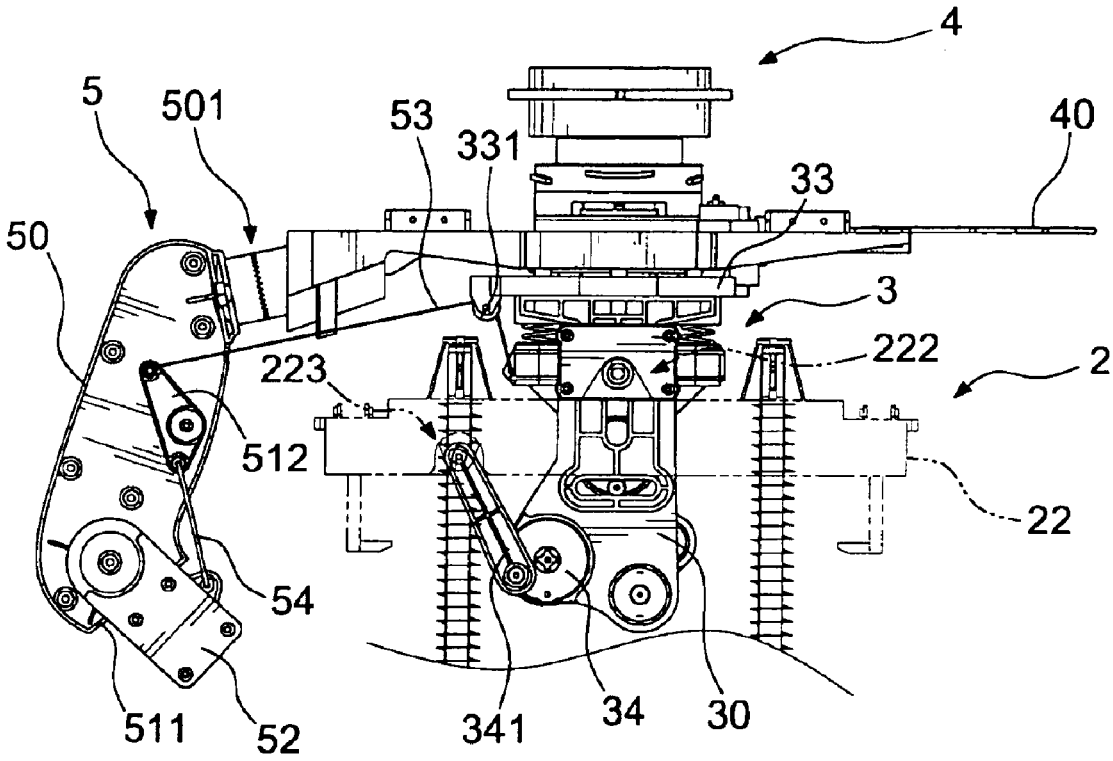
FIG. 6 is an enlarged front view of the upper portion of the robotic toy in FIG. 3.

With further reference to FIG. 6, the rocker wheel (34) is countersunk, mounted rotatably on the front and close to the bottom of the hollow body (30), driven by the gear assembly (32) and has a center, a drive post and a rocker arm (341). The drive post is formed eccentrically on the rocker wheel (34). The rocker arm (341) is connected between the drive post on the rocker wheel (34) and the rocker arm mount (223) on the upper bracket (22).

The lifting wheels (37) are countersunk, are rotatably mounted respectively on the front and back below the pairs of guide rails (301) on the hollow body (30) and are rotated by the gear assembly (35). Each lifting wheel (37) has a center and a drive post. The drive posts are eccentrically formed respectively on the lifting wheels (37).

The lifting arms (38) are mounted slidably and respectively between the pairs of the guide rails (301) and are connected respectively to and driven respectively by the lifting wheels (37) on the front and back of the hollow body (30). Each lifting arm (38) has a top, a bottom, a longitudinally slot (382) and a transverse slot (383). The longitudinally slot (382) is defined through the lifting arm (38) and is mounted on the guide post (302) that extends through the longitudinal slot (382). The transverse slot (383) is defined through the lifting arm (38) below and perpendicular to the longitudinal slot (382) and is mounted on the drive post on the corresponding lifting wheel (37).

The shoulder bracket (33) is mounted on the tops of the lifting arms (38) and has a top surface, a bottom surface, two sides and a pulley (331). The pulley (331) is mounted rotatably on the bottom surface and adjacent to one of the sides of the shoulder bracket (33).

The springs (39) are mounted securely between the hollow body (30) and the bottom surface of the shoulder bracket (33).

The shoulder (4) is attached to the top surface of the shoulder bracket (33) and has two sides and a mounting rod (40). The mounting rod (40) is attached securely to the side of the shoulder (4) and is used to mount a decoration such as a guitar or drum.

The arm assembly (5) is mounted rotatably on the opposite side of the shoulder from the mounting rod (40) and has a hollow upper arm (50), a forearm (52), a transmission cord (53) and a forearm cord (54).

The hollow upper arm (50) is mounted on a side of the shoulder (4) and has an upper end, an optional rotating joint (501), an open lower end (511) and a control lever (512). The upper end is attached to the side of the shoulder (4) close to the pulley (331) on the shoulder bracket (33). The rotating joint (501) may connect the upper end of the hollow upper arm to the side of the shoulder (4) close to the pulley on the shoulder bracket (33) to allow the hollow upper arm (50) to rotate. The control lever (512) is mounted pivotally inside the hollow upper arm (51) and has a proximal end and a distal end.

The forearm (52) is mounted pivotally inside and protrudes from the open lower end (511) of the upper arm (51).

The transmission cord (53) is connected to the hollow body (30) of the transmission device (3) and the proximal end of the control lever (512) and extends through the pulley (331) on the shoulder bracket (33).

The forearm cord (54) is connected to the distal end of the control lever (512) and the forearm (52).

The body casing assembly (6) is mounted on the shoulder (4), covers the transmission device (3) and has a front casing (60), a rear casing (61) and at least one boot cord (62). The front casing (60) is attached securely to the shoulder (4) and has a bottom edge (601) and an inner surface. The rear casing (61) is attached securely to the front casing (61). The at least one boot cord (62) is connected to the bottom edge of the front casing (60) and to the eye (122) on the boot (12).

Figure 10:
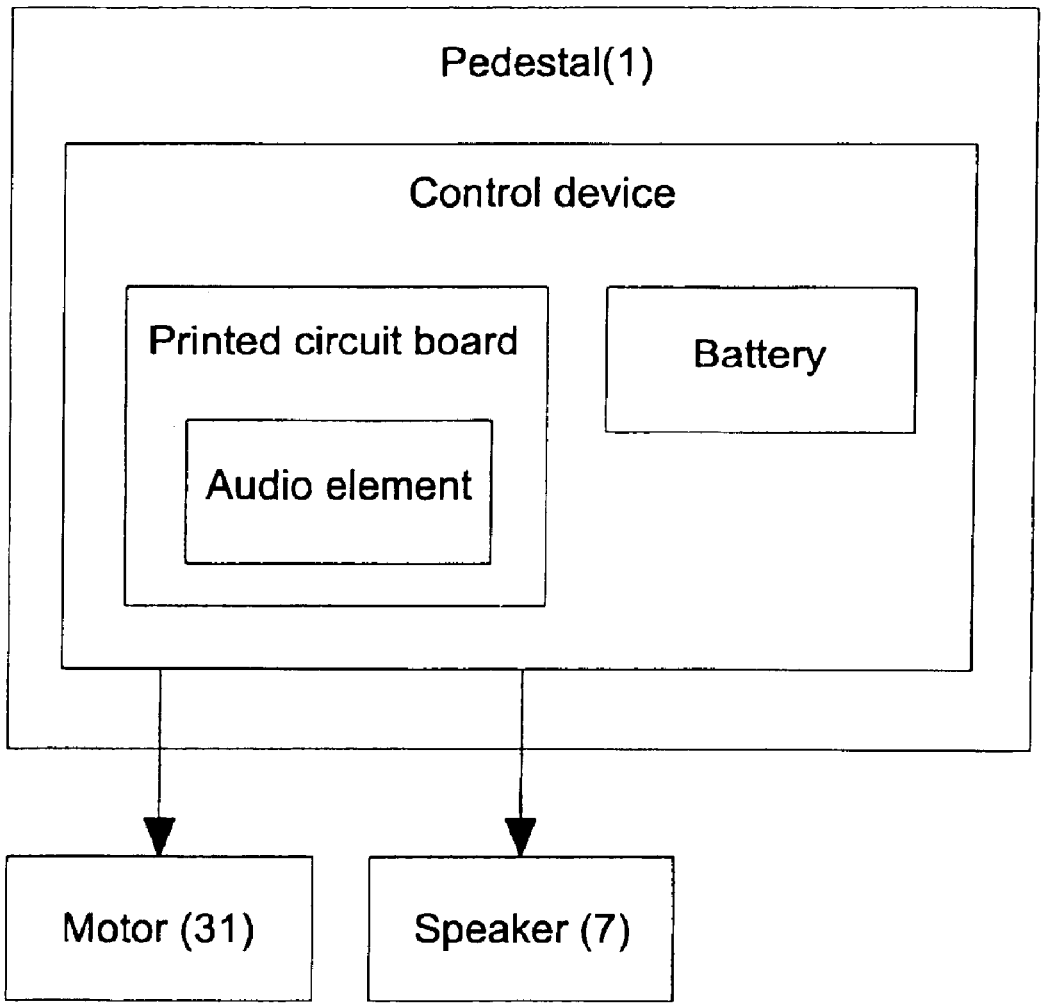
FIG. 10 is a set of block diagrams of the control device, motor and speaker of the robotic toy in FIG. 1.

With reference to FIG. 10, the control device is mounted inside the pedestal (10) and has a battery, a printed circuit board and an audio element. The printed circuit board is electrically connected to the motor (31). The speaker (7) is attached to the inner surface of the front casing (60), is electrically connected to the printed circuit board and receives electronic signals from the audio element to broadcast music, sounds or voices. The control device controls the operation of either or both the motor (31) and the optional speaker (7).

Figure 7:
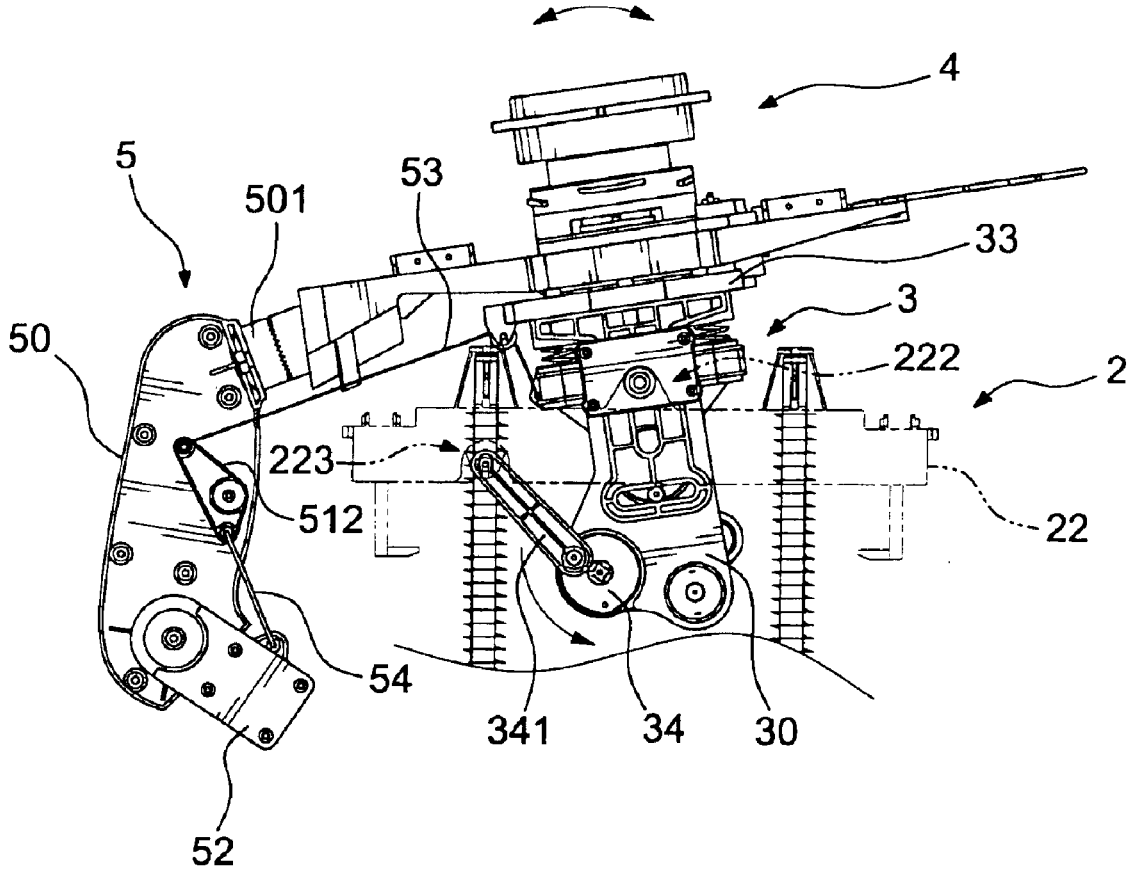
FIG. 7 is an operational view of the robotic toy in FIG. 6 with shoulder and arm assembly swaying right and left.
Figure 9:
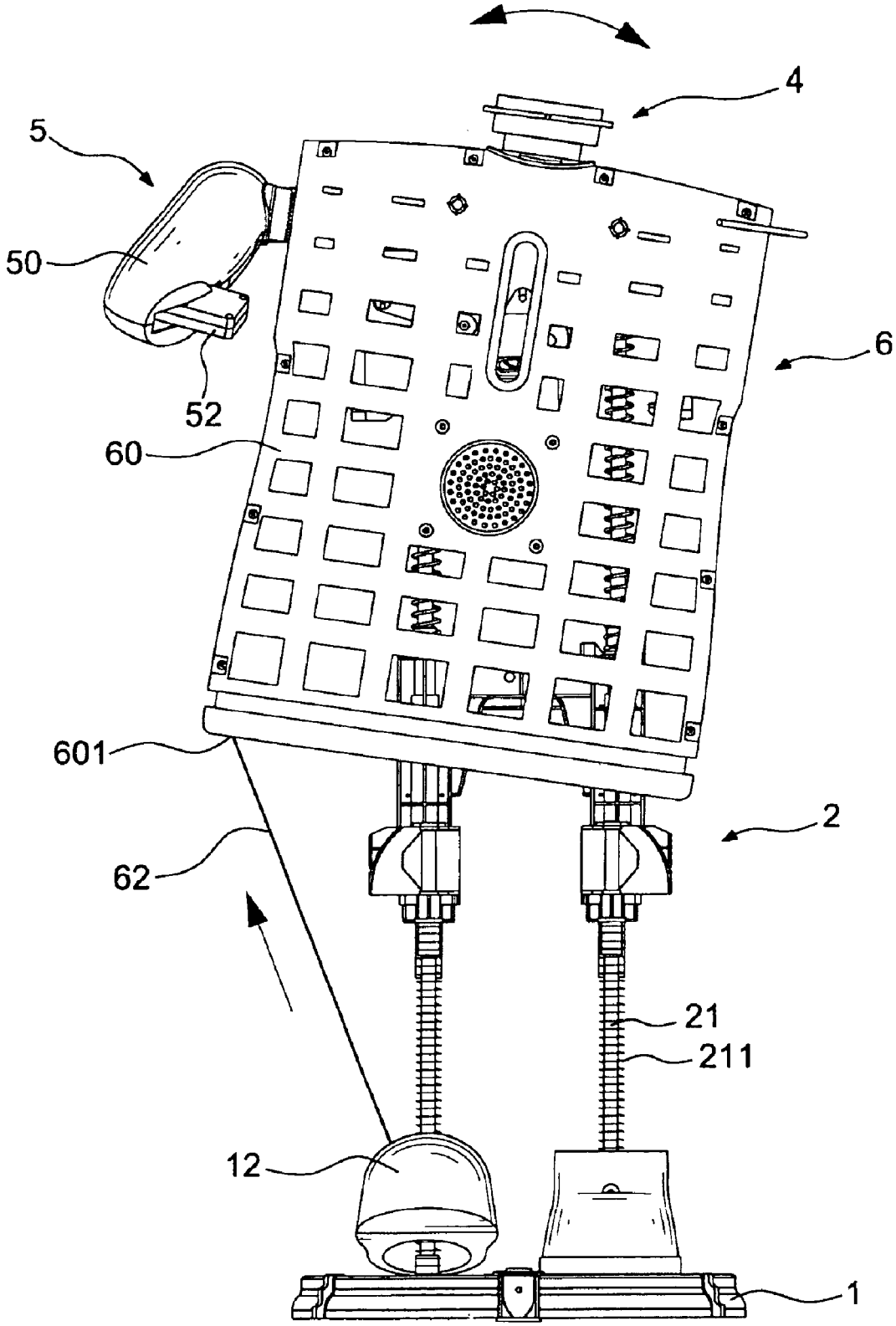
FIG. 9 is an operational view of the robotic toy in FIG. 1 with the boot pivoting and the body casing assembly simultaneously swaying.

With further reference to FIGS. 7 and 9, the transmission device (3), the shoulder (4), the arm assembly (5) and the body casing assembly (6) rock right and left when the motor (31) operates. The motor (31) rotates the gear assembly (32) that rotates the rocker wheel (34). The rotating rocker wheel (34) pulls and pushes the rocker arm (341) that pivots on the rocker arm mount (223) on the upper bracket (22) and rocks the transmission device (3) right and left in the transmission-pivoting hole (221) in the upper bracket (20). The shoulder (4), arm assembly (5) and body casing assembly (6) attached directly or indirectly to the transmission device (3) are also rocked right and left.

Figure 8:
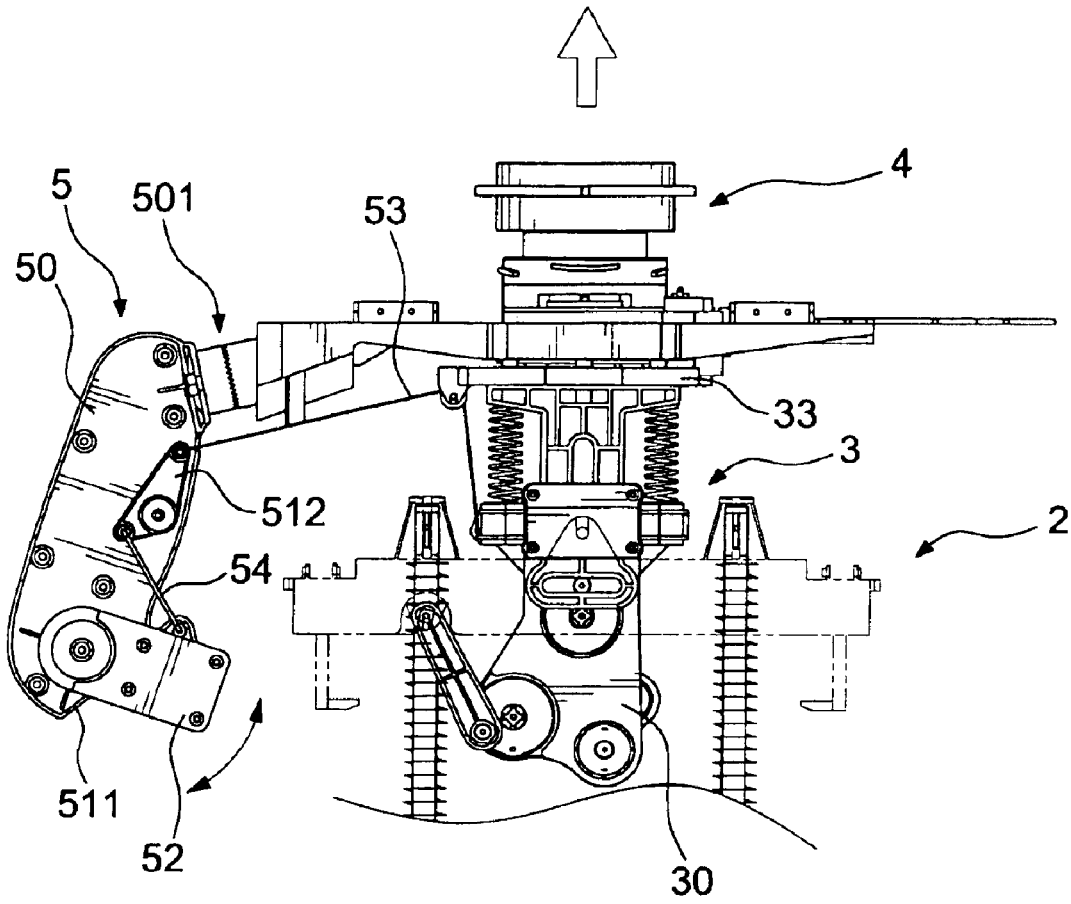
FIG. 8 is an operational view of the robotic toy in FIG. 6 with the shoulder oscillating up and down and the forearm moving up and down.

With further reference to FIG. 8, the shoulder (4), arm assembly (5) and body casing assembly (6) oscillate up and down relative to the transmission device (3) and the forearm (52) simultaneously pivots up and up and down when the motor (31) operates. The gear assembly (5) is turned by the operating motor (31) and rotates the lifting wheels (37). The rotating lifting wheels (37) drive the lifting arms (38) up and down quickly, and thereby the shoulder bracket (33), shoulder (5), arm assembly (5) and body casing assembly (6) oscillate up and down relatively to the hollow body (30). The oscillation of the shoulder bracket (33) relatively to the hollow body (30) varies the distance between the pulley (331) on the shoulder bracket (33) and the hollow body (30) and causes the transmission cord (53) to slide right and left through the pulley (33 1). The sliding transmission cord (53) pivots the control lever (512) inside the hollow upper arm (51). The pivoting control lever (512) pulls the forearm cord (54), which pivots the forearm (52) up and down. When a hand is attached to the pivoting forearm (52), the motion of the forearm (52) appears to be playing a decorative music instrument mounted on the mounting rod (40).

With further reference to FIG. 9, the oscillation or rocking of the body casing assembly both change the distance between the bottom edge (601) of the front casing (60) and the pedestal (1), which pulls the at least one boot cord (62) intermittently to cause the boot (12) or boots (12) connected to the front casing (60) to pivot up and down. The pivoting boot (12) in company with the pivoting forearm (52) and the decorative instrument looks like beating time.

The stand assembly (2) can be shortened to accommodate storage of the robotic toy. The stand assembly (2) is shortened by pressing the upper bracket (22) toward the medial bracket (20), compressing the upper springs **(211*a*) and simultaneously sliding the upper stand (21*a*) down into the upper sleeves (203*a*). The hooks (224) on the upper bracket (22) respectively hook the corresponding fasteners (204) and prevent the upper bracket (22) from being raised by the resilient force of the upper springs (211*a*)**.

The robotic toy in accordance with the present invention can have an exquisite human or animal appearance to become more attractive. Playing a musical instrument with the forearm (52), beating time with the boot (12) and rocking of the body casing (6) make the robotic toy in accordance with the invention look funny, lifelike and more attractive for people especially children.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A robotic toy comprising:

a pedestal having a top surface;

two sets of multiple mounting sleeves formed on the top surface of the pedestal and beside each other, wherein the mounting sleeves in each set are arranged at intervals, and each mounting sleeve has an open top;

two boot-pivoting members formed on the top surface of the pedestal and respectively behind the sets of mounting sleeves; and two boots pivotally attached respectively to the boot-pivoting members and around the sets of mounting sleeves and each boot having a front top surface;

a bottom edge having a back part pivotally attached to a corresponding one of the boot-pivoting members;

a through hole defined vertically through the boot and corresponding to a set of mounting sleeves; and an eye formed on the front top surface of the boot;

a stand assembly mounted on the pedestal and having two sets of multiple lower stands corresponding to and mounted respectively in the sets of mounting sleeves on the pedestal and each lower stand having a bottom end mounted securely inside the open top of a corresponding mounting sleeve;

a top end; and a lower spring mounted around the lower stand and having a top end and a bottom end abutting the open top of the corresponding mounting sleeve;

a medial bracket mounted slidably on the lower stands, abutting the top ends of the lower springs and having a top;

a bottom;

two legs formed on the bottom of the medial bracket and corresponding to the sets of lower stands, and each leg having a bottom end and an outer side;

two sets of multiple lower sleeves formed on the bottom ends of the legs of the medial bracket, corresponding to the sets of lower stands and the lower springs, mounted respectively around the lower stands and respectively abutting the top ends of the lower springs;

two upper sleeves formed on the top of the medial bracket, and each upper sleeve having a through hole defined through the upper sleeve; and two fasteners mounted respectively on the outer sides of the legs of the medial bracket;

two upper stands corresponding to the upper sleeves and mounted respectively in the open top ends of the upper sleeves and each upper stand having a top end; and an upper spring mounted around the upper stand and having a top end and a bottom end abutting the open top end of the corresponding sleeve; and an upper bracket mounted securely on the top ends of the upper stands, and having a top surface;

a bottom surface abutting the top ends of the upper springs;

a front;

two sides;

a transmission-pivoting hole defined through the upper bracket;

two transmission-pivoting mounts formed on the top surface of the upper bracket and respectively in front of and behind the transmission-pivoting hole;

a rocker arm mount formed on the bottom surface close to one of the side of the upper bracket; and two hooks formed respectively on the sides of the upper bracket;

a transmission device mounted pivotally through the transmission-pivoting hole in the upper bracket and having a hollow body mounted pivotally between the transmission-pivoting mounts through the transmission-pivoting hole and having a top;
a bottom;
a front;
a back;
two sides;
two pairs of guide rails formed respectively on the front and back, adjacent to the sides and close to the top of the hollow body;
two guide posts formed respectively between the pairs of guide rails on the front and back; and
two covers corresponding to and mounted respectively on the pairs of guide rails;

a motor mounted inside the hollow body;

a gear assembly mounted inside the hollow body and having multiple gears engaged with each other and rotated by the motor;

a rocker wheel being countersunk, mounted rotatably on the front and close to the bottom of the hollow body, driven by the gear assembly and having
a center;
a drive post formed eccentrically on the rocker wheel; and
a rocker arm connected between the drive post on the rocker wheel and the rocker arm mount on the upper bracket;

two lifting wheels being countersunk, rotatably mounted respectively on the front and back below the pairs of guide rails on the hollow body and rotated by the gear assembly; and each lifting wheels having a center and a drive post eccentrically formed on the lifting wheel;

two lifting arms mounted slidably and respectively between the pairs of guide rails and connected respectively to and driven respectively by the lifting wheels on the front and back of the hollow body, and each lifting arm having
a top;
a bottom;
a longitudinal slot defined through the lifting arm and mounted on the guide post that extends through the longitudinal slot; and
a transverse slot defined through the lifting arm below and perpendicular to the longitudinal slot and mounted on the drive post on the corresponding lifting wheel; and a shoulder bracket mounted on the tops of the lifting arms and having a top surface, a bottom surface, two sides and a pulley mounted rotatably on the bottom surface and adjacent to one of the sides of the shoulder bracket;

a shoulder attached to the top surface of the shoulder bracket and having two sides and a mounting rod mounted attached securely to the side of the shoulder;

an arm assembly mounted on the opposite side of the shoulder from the mounting rod and having
a hollow upper arm mounted on a side of the shoulder and having
an upper end attached to the side of the shoulder close to the pulley on the shoulder bracket;
an open lower end; and
a control lever mounted pivotally inside the hollow upper arm and having a proximal end and a distal end;

a forearm mounted pivotally inside and protruding from the open lower end of the upper arm;

a transmission cord connecting to the hollow body of the transmission device and the proximal end of the control lever and extending through the pulley on the shoulder bracket; and a forearm cord connected to the distal end of the control lever and the forearm; and a body casing assembly mounted on the shoulder, covering the transmission device and having
a front casing attached securely to the shoulder and having a bottom edge and an inner surface; and
a rear casing attached securely to the front casing; and
at least one boot cord connected to the bottom edge of the front casing and the eye on the boot.

2. The robotic toy as claimed in claim 1, wherein the hollow arm upper arm of the arm assembly further comprises a rotating joint connected to the upper end of the hollow upper arm rotatably to the side of the shoulder close to the pulley on the shoulder bracket.

3. The robotic toy as claimed in claim 2, wherein the transmission device further has two springs mounted securely between the hollow body and the bottom surface of the shoulder bracket.

4. The robotic toy as claimed in claim 3 further comprising a control device mounted inside the pedestal, electrically connected to the motor and having a battery and a printed circuit board electrically connected to the motor and having an audio element; and a speaker mounted on the inner surface of the front casing, electrically connected to the printed circuit board and receiving the electronic signals from the audio element to music, sound and voices.

5. The robotic toy as claimed in claim 1, wherein the transmission device further has two springs mounted securely between the hollow body and the bottom surface of the shoulder bracket.

6. The robotic toy as claimed in claim 1 further comprising a control device mounted inside the pedestal, electrically connected to the motor and having a battery and a printed circuit board electrically connected to the motor and having an audio element; and a speaker mounted on the inner surface of the front casing, electrically connected to the printed circuit board and receiving the electronic signals from the audio element to music, sound and voices.

* * * * *